United States Patent [19]

Hodgson et al.

[11] Patent Number: 5,011,077

[45] Date of Patent: Apr. 30, 1991

[54] RAILWAYS

[75] Inventors: William H. Hodgson, Braithwaite; Colin G. Stanworth, Marchington; David J. Thompson, Derby, all of England

[73] Assignees: British Steel plc; British Railways Board, both of London, England

[21] Appl. No.: 409,568

[22] Filed: Sep. 18, 1989

[30] Foreign Application Priority Data

Sep. 22, 1988 [GB] United Kingdom ..... 8822293

[51] Int. Cl.[5] ..... E01B 9/68

[52] U.S. Cl. ..... 238/283; 267/141

[58] Field of Search ..... 238/264, 283, 287, 382; 267/141

[56] References Cited

U.S. PATENT DOCUMENTS

| | | | |
|---|---|---|---|
| 2,057,955 | 10/1936 | Kahn | 238/283 |
| 2,214,628 | 9/1940 | Upchurch, Jr. | 238/283 |
| 2,688,005 | 8/1954 | Clayton, Jr. et al. | 238/283 X |
| 3,223,328 | 12/1965 | Moses et al. | 238/382 X |
| 3,662,951 | 5/1972 | Smith et al. | 238/283 |
| 4,216,904 | 8/1980 | Vivion | 238/283 |
| 4,355,578 | 10/1982 | Raquet | 238/382 X |
| 4,811,947 | 3/1989 | Takatsuka et al. | 267/141 |

FOREIGN PATENT DOCUMENTS

| | | | |
|---|---|---|---|
| 1232971 | 10/1960 | France | 238/283 |
| 7701846 | 6/1977 | Netherlands | 238/283 |
| 105143 | 6/1942 | Sweden | 238/283 |
| 505136 | 5/1939 | United Kingdom | 238/283 |
| 1554150 | 10/1979 | United Kingdom . | |
| 2121461A | 12/1983 | United Kingdom . | |

*Primary Examiner*—Andres Kashnikow
*Attorney, Agent, or Firm*—Bacon & Thomas

[57] ABSTRACT

A rail which has secured to it a composite body for absorbing vibrational energy whereby to reduce noise generated by vehicular traffic on the rail. The composite body comprises a visco-elastic damping medium 5 bonded to, and sandwiched between, both the rail and a constraining member, e.g. a steel strip 6, substantially stiffer in tension than the damping medium.

18 Claims, 5 Drawing Sheets

RAILWAYS

Figure 1:
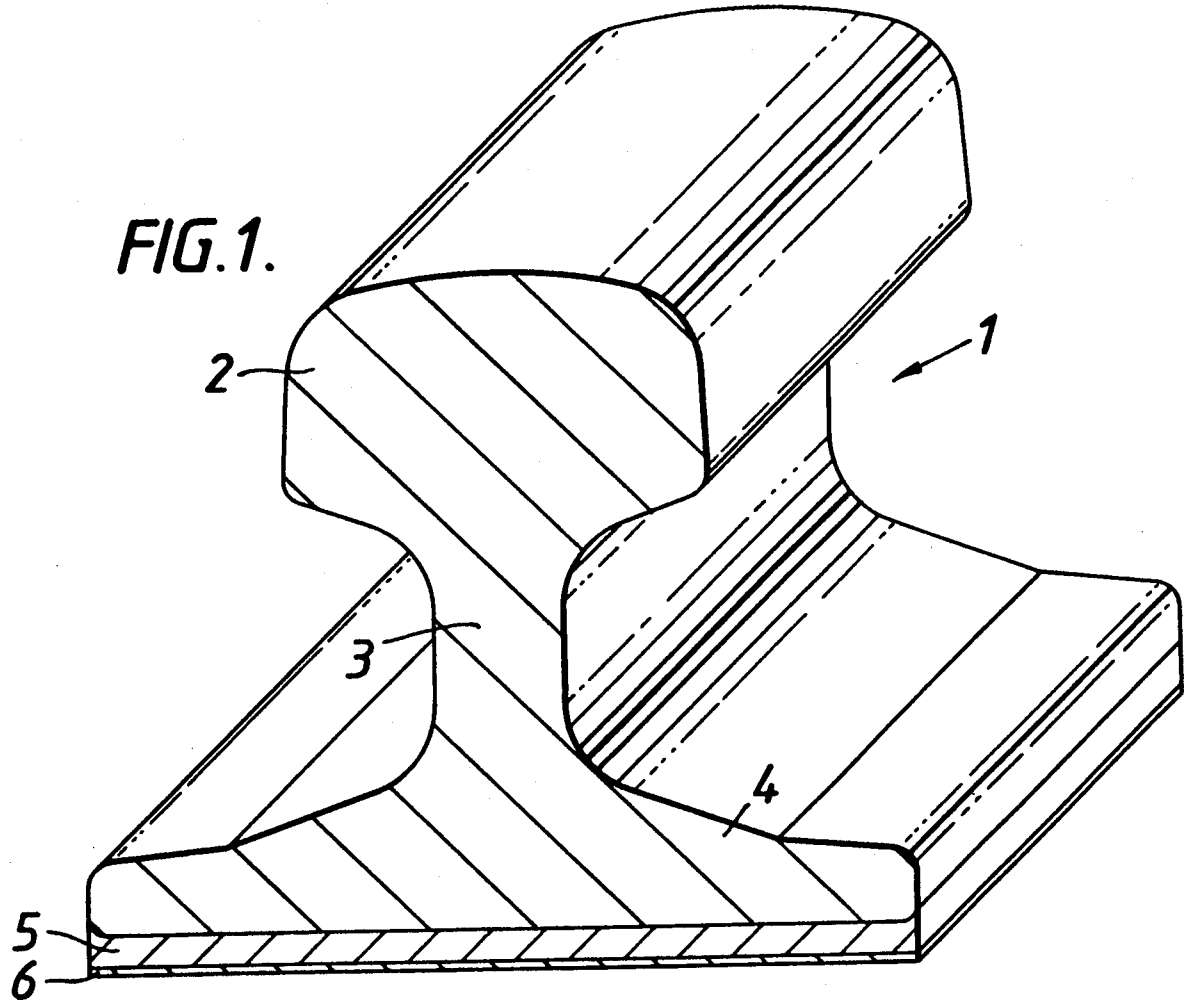

This invention relates to railways, and more particularly relates to reducing wheel/rail noise arising in same.

From one aspect the present invention comprises a steel rail having secured to it a composite body for absorbing vibrational energy generated by vehicular traffic on said rail, the composite body comprising a damping medium bonded to, and sandwiched between, both the rail and a constraining member substantially stiffer in tension than the damping medium.

The rail preferably has a reduced height compared with the 'standard' cross-section of such rails for a common permanent way, whereby to aid further the benefits of this invention.

The composite body is preferably continuous along the length of the rail; a visco-elastic material may be used as the damping medium and it may be secured on one or both sides of the web and/or the upper sides of the foot and/or the bulk of the non-wheel contacting parts of the head and/or of course on the underside of the foot. The constraining member may be a strip of steel or, where the damping medium is applied to the underside of the foot, the contraining member may be the continuous track support itself, e.g. a paved (concrete) foundation.

It is recognised that train noise arises about equally from the wheels of same and the rails on which they run, and this invention is dedicated to reducing the rail contribution to the total. Noise radiation from the rails normally extends over a frequency range from a little below 250 Hz to, at most, 5 kHz. In tackling a reduction in rail noise it is desirable to reduce the effective radiating length of the rail, that is, to increase the vibration decay rate, with distance, along the rail of wave motions propagating along the rail from the wheel/rail contact position. For this purpose the application of the constrained layer damping material in the manner specified above has a most beneficial effect above a frequency of about 2 kHz where it damps this motion, particularly in the embodiment where the foot motion is damped, which is increasingly the more dominant radiating component. Considering now frequencies below this level, the noise radiation efficiency of a vibrating beam (rail) depends on its projected width/depth compared with the wavelength of sound, in air, at the frequency concerned. Efficient radiation only occurs when the 'effective diameter' of the rail is greater than the wavelength—when the projected width/depth is significantly less than the wavelength the radiation efficiency falls drastically. The boundary between these two regimes is the critical frequency, and the adoption of the reduced height rail is beneficial up to about 1 kHz based on an increase in the critical frequency and, thereby, a reduction in radiating efficiency. An additional benefit arising from the use of this rail section is that it reduces the radiating surface area.

In order that the invention may be fully understood, four embodiments thereof will now be described with reference to the accompanying drawings each of which schematically illustrates a rail according to this invention.

Referring now to FIG. 1, the 'dumpy' steel rail section 1 has a head 2 a reduced vertical web 3 and a foot 4. The rail height is of the order of 110 mm and the width of the foot is of the order of 140 mm; its weight, per meter length, is of the order of 50 kg. Bonded, e.g. by an adhesive, to the foot is a visco-elastic (that is, not simply elastic) layer 5 of, for example, the proprietary material T.MAT PD4 and likewise this is bonded on its other side to a metallic, eg steel, constraining layer 6. The layer 5 may have pre-treated adherent surfaces for this purpose.

The layer 5 may additionally be sufficiently resilient to perform the function of a rail seating pad.

Figure 2:
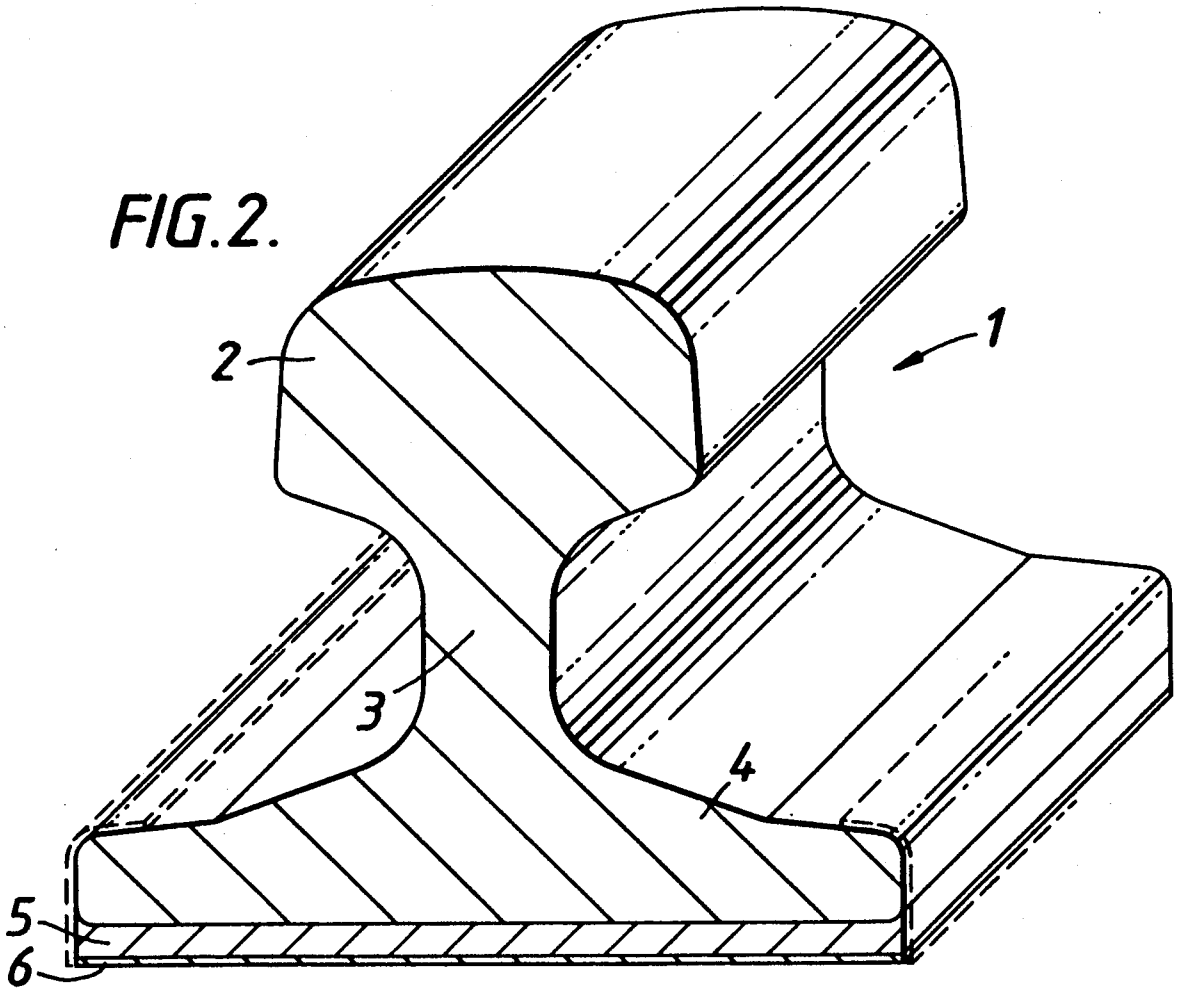

FIG. 2 shows a better proportioned rail whereby the height of the foot has been increased by 5 mm. This effectively alters the neutral axis to better balance the stress distribution and facilitate easier rolling, in particular a straighter rail is achieved on the cooling beds. The extra weight in this rail furthermore facilitates 'matching' dimensional changes between rail of this section and standard sections to which it must join, eg in switches and crossings.

Figure 4:
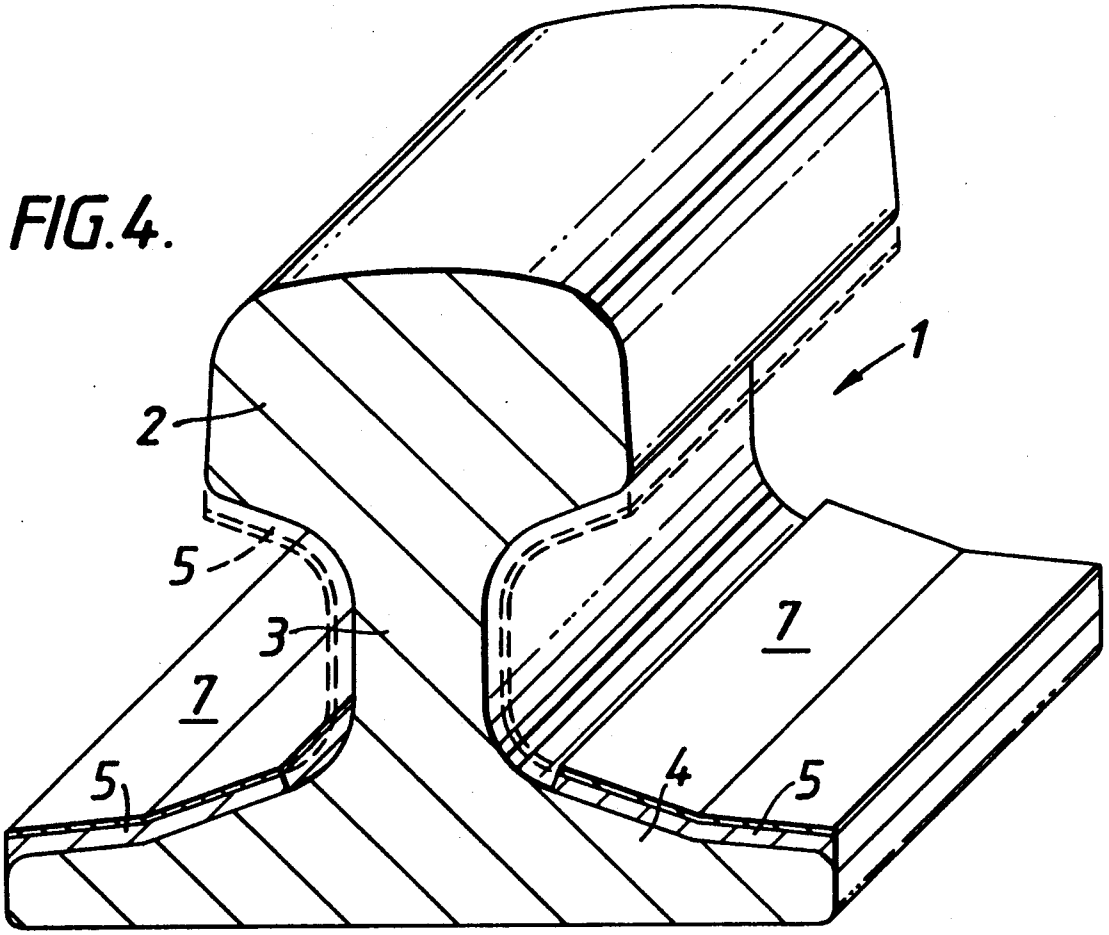

Additionally, as shown in FIG. 2, the steel layer 6 which may be a "soft" steel, e.g. 110 Brinel, may optionally be bent upwardly around the sides and crimped over the top of the foot, as shown—the visco-elastic layer 5 may also be wrapped round in this fashion, cf, FIG. 4.

Figure 3:
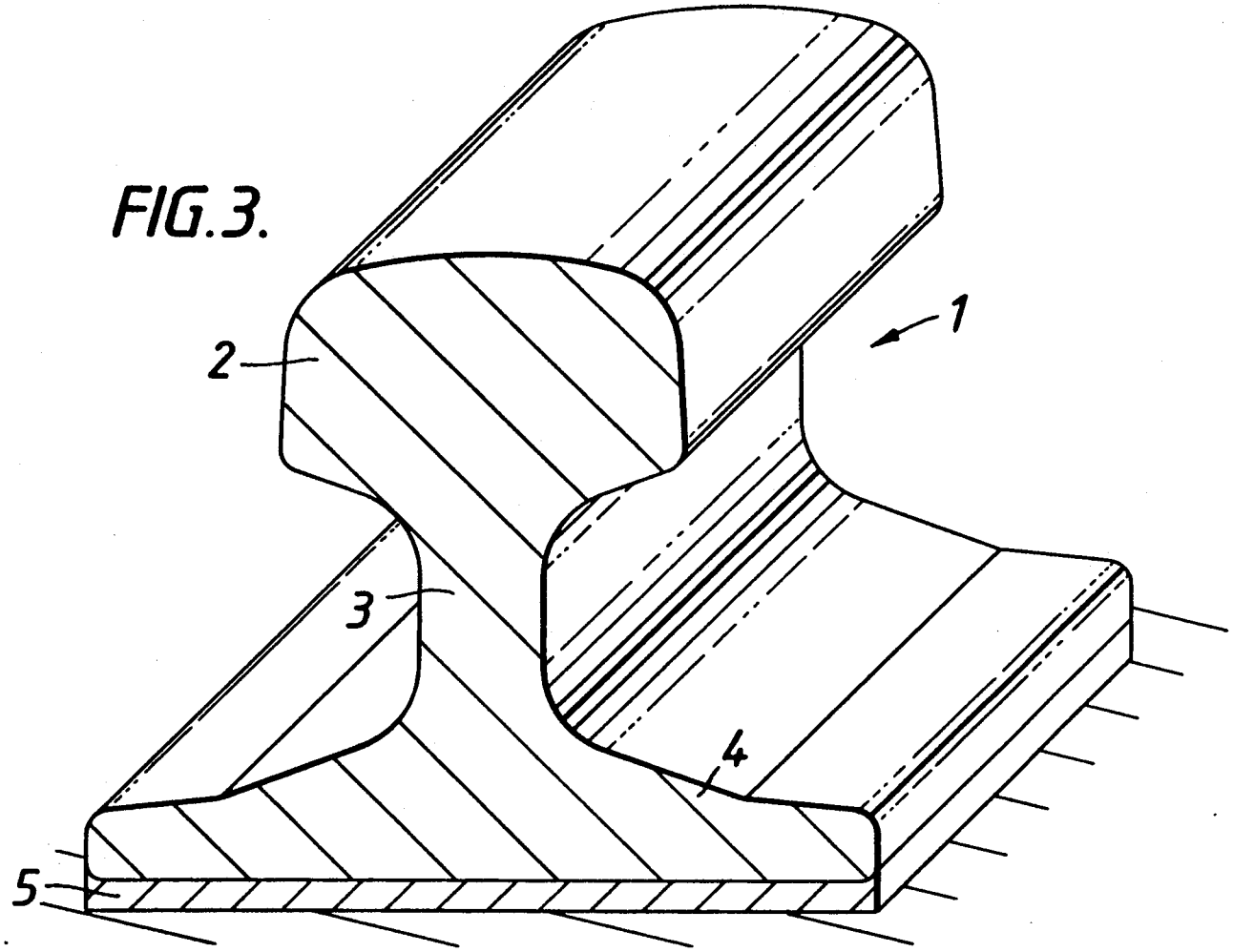

The layers 5, 6 are continuous along the length of the rail in both embodiments and the rail is periodically supported along its length by sleepers (not shown). Alternatively, the rail may in some circumstances be supported continuously along its length on e.g. a concrete bed, and in this instance the separate contraining layer 6 may be omitted, the layer 5 being bonded to this bed as shown in FIG. 3.

Alternatively, or additionally, to siting the composite body, 5,6 on the underside of the foot this body may be sited elsewhere on the rail, e.g. on one or both sides of the web and/or around the bulk of the non-wheel contacting parts of the head and/or, most notably, the upper sides of the foot.

FIG. 4 shows one such example of the latter where the visco-elastic layer 5 is bonded on one side to the upper sides of the foot and on its other side to a steel strip 7 which is otherwise freely exposed. As before the vibrational energy travelling within the rail is absorbed by the visco-elastic layer, being manifested as heat within the composite body. As foreshadowed above, this composite body may be extended over the web and the underside of the head, as shown be the dotted outline in this Figure, and indeed it may embrace the sides of the head as well.

Although the invention has been described with reference to the particular embodiments illustrated it is to be understood that various changes may readily be made without departing from this invention. For example the dimensional relationships of the composite layers shown, in relation to one another and to the rail, may readily be changed as indeed may the shape of the rail itself consistent with the object of this invention, indeed the rail might in fact have no web. Further, it is desirable but not essential for the composite layer to be continuous, the same object would be achieved by discrete bonded layers between each sleeper and/or rail fastening and the rail itself but this would be less effective at lower frequencies. Moreover, although the layers 5, 6/7 are shown as being pre-formed one or both may alternatively be sprayed or trowelled on, and the layers 6/7 may be any material stiffer in tension than layer 5 eg. a plastics material could be used.

Figure 5:
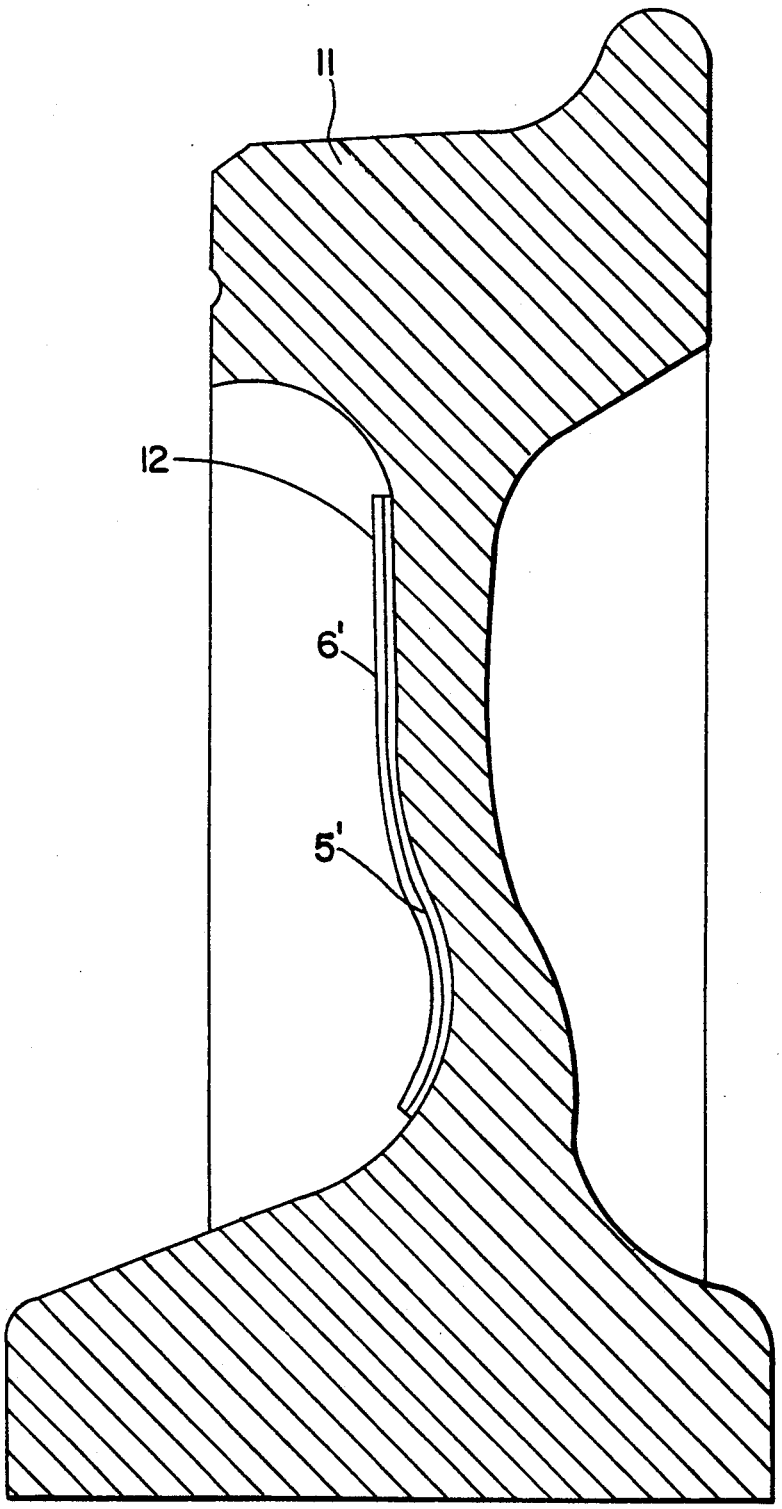

Clearly, the greatest benefit in noise reduction will be achieved when the wheels of the vehicles traversing these rails have themselves been treated to reduce their own resonant response; thus the invention is particularly beneficial when rails as described herein are used in conjunction with damped wheels e.g. wheels the web and/or rim of which have a composite body affixed thereto in the fashion described, as shown in FIG. 5 wherein wheel 11 is provided with composite body 12 comprised of layers 5' and 6' corresponding to layers 5 and 6 previously described.

We claim:

1. A steel rail having secured to it a composite body for absorbing vibrational energy generated by vehicular traffic on said rail, the composite body comprising a viscoelastic material bonded to, and sandwiched between, both the rail and a constraining member substantially stiffer in tension than the visco-elastic material.

2. A rail according to claim 1, wherein said rail comprises a rail head and rail foot jointed by a vertically extending rail web.

3. A rail according to claim 2, wherein the constraining member is strip steel.

4. A rail according to claim 2, wherein the visco-elastic material is bonded to the underside of the foot and the strip is bent upwardly around the sides of the foot and crimped over the top of said foot.

5. A rail according to claim 4, wherein the visco-elastic material is also bent around the sides and over the top of said foot.

6. A rail according to claim 3, wherein the visco-elastic material and the constraining member are continuous along the length of the rail.

7. A rail according to claim 2, wherein the visco-elastic material is bonded to the underside of the foot of the rail continuously along its length and wherein the constraining member is constituted by the track support.

8. A rail according to claim 7, wherein the visco-elastic material is continuous along the length of the rail and the track support is a paved concrete foundation.

9. A rail according to claim 2, wherein the visco-elastic material is bonded to the underside of the rail foot.

10. A rail according to claim 2, wherein the visco-elastic material is bonded to the upper sides of the rail foot.

11. A rail according to claim 2, wherein the visco-elastic material is bonded to at least one side of the rail web.

12. A rail according to claim 2, wherein the rail head comprises a wheel contacting portion and a non-wheel contacting portion and the visco-elastic material is bonded to the bulk of the non-wheel contacting portion.

13. A rail according to claim 1, wherein the constraining member is a strip of material which is different from the visco-elastic material.

14. A rail according to claim 1, adapted to be used in conjunction with vehicular traffic having wheels which have been treated to reduce their own resonant response.

15. A steel rail having secured to it continuously along its length a composite body for absorbing vibrational energy generated by vehicular traffic on said rail, the composite body comprising a visco-elastic material adhesively bonded to, and sandwiched between, both the rail and a constraining layer substantially stiffer in tension than the damping medium.

16. A rail according to claim 15, wherein the composite body is secured to and runs along the length of the underside of the rail foot.

17. A rail according to claim 16, wherein the constraining layer is strip steel.

18. A rail according to claim 17, wherein the composite body is additionally secured to the web of the rail.

* * * * *